US005079894A

United States Patent [19]

Lau

[11] Patent Number: 5,079,894

[45] Date of Patent: Jan. 14, 1992

[54] WOODEN X-BEAM

[75] Inventor: Peter W. Lau, Gloucester, Canada

[73] Assignee: Forintek Canada Corp., Ottawa, Canada

[21] Appl. No.: 711,501

[22] Filed: Jun. 3, 1991

Related U.S. Application Data

[63] Continuation of Ser. No. 542,569, Jun. 25, 1990, abandoned.

[51] Int. Cl.[5] ..... E04C 3/02; E04C 3/12

[52] U.S. Cl. ..... 52/732; 52/729; 52/730; 52/733; 52/738

[58] Field of Search ..... 52/723, 720, 729, 730, 52/732, 733, 730, 721, 642, 690, 376

[56] References Cited

U.S. PATENT DOCUMENTS

| | | | |
|---|---|---|---|
| 139,904 | 6/1873 | Lummus | 52/376 |
| 4,191,000 | 3/1980 | Henderson | 52/729 |
| 4,446,668 | 5/1984 | Christ-Janar | 52/729 |

FOREIGN PATENT DOCUMENTS

| | | | |
|---|---|---|---|
| 80770 | 7/1951 | Czechoslovakia | 52/730 |
| 28419 | 11/1956 | Finland | 52/730 |
| 1230119 | 9/1960 | France | 52/730 |
| 781627 | 8/1957 | United Kingdom | 52/730 |
| 1258456 | 12/1957 | United Kingdom | 52/730 |
| 793593 | 4/1958 | United Kingdom | 52/730 |

*Primary Examiner*—Richard E. Chilcot, Jr.
*Assistant Examiner*—Robert Canfield
*Attorney, Agent, or Firm*—Stanley E. Johnson

[57] ABSTRACT

A multi component wood construction member that has an X-beam appearance, and useful as a structural beam or post. The member has an elongate web section with flange members securely attached to opposite sidewalls thereof that, in beam cross-section, the web is inclined. One surface of each of the flanges respectively forms all or a major part of the top and bottom surfaces of the beam. The other-surfaces of each of the flanges are respectively in contact with and fixed to opposite sides of the web and preferably extend inward of the web to a depth equivalent to at least one half the depth of the beam.

9 Claims, 1 Drawing Sheet

WOODEN X-BEAM

This application is a continuation of application Ser. No. 07/542,569 filed June 25, 1990, now abandoned.

BACKGROUND OF THE INVENTION

The present invention relates to wooden structural members which can be used as beams, joists, studs, posts or the like.

Hitherto, where savings in weight or material cost is of importance, conventional lumber which is rectangular in cross-section, has been substituted by wooden I-beams or X-beams.

For example, a wooden I-beam is disclosed in U.S. Pat. No. 4,191,000 issued Mar. 4, 1980—L. R. Henderson. The tongue-and-groove connections between the central web and two outer flanges of this type of wood I-beam may limit the allowable design load of the beam given certain beam width and depth dimensions. This is due to the strength capacity of the web and flange connections, which is determined mainly by the amount of contact area available between the web and the flange, which is usually limited. Moreover, the shear strength capacity of typical tongue-and-groove connections in wooden I-beams cannot be readily increased, unless the design of the connection is itself altered.

A further drawback characteristic of wooden I-beams is differential thickness swelling, and which is encountered between the flange and web at the tongue-and-groove connection. When moisture is absorbed, the web member tongue swells, whilst the groove in the flange member shrinks; and vice versa, when moisture is desorbed. Differential lateral movement repeated over time will result in separation of the glue bond between the tongue and the groove, or in splitting of the flange members at the tongue-and-groove joint location.

Christ-Janer in U.S. Pat. No. 4,446,668 issued May 8, 1984 discloses a novel wooden X-beam construction which employs, in cross-section, two webs which are centrally joined together along their length and which have disposed therebetween, top and bottom wedge shaped flanges. The Christ-Janer form of X-beam construction is very restricted in terms of manufacturing flexibility. Sizes of beams are not easily changed, as each time the configuration is changed, a new moulded shape of the web members, which accommodate the flanges, is required. Problems due to thickness swelling or shrinkage also exist, since the opposed web members, which are centrally connected, resist lateral movement resulting from swelling or shrinkage of the wedges disposed above and below the central connection of the two webs. As a result, lateral swelling of the wedge flange members exerts a tensile stress on the connection between the two web members. Conversely, lateral shrinkage puts a tensile stress on the connection between the flanges and the web members.

SUMMARY OF INVENTION

The novel wooden structural member of this invention, like the known wooden I-beams, is constructed from two flange elements, and a single web element. However, in cross-section, it has the appearance of a X-beam.

In accordance with this invention, the elongate wooden beam, post or the like structural member, like its I-beam counterpart, has spaced apart, planar and parallel, first and second beam surfaces extending the length of the member. However, and unlike the I-beam, the elongate web section, in cross-section, is inclined and extends diagonally across the member from one edge of the first beam surface to an edge of the second beam surface. Further, and in lieu of I-beam flanges which are rectangular in cross-section, first and second wedge shaped flanges, which extend the length of the member, are disposed on either side of the web. Each flange has an exterior wall respectively forming all or a major portion of the first and the second beam surfaces. Two flange sidewalls taper relatively inwardly in a direction away from the exterior wall, with one of the flange sidewalls of each flange being respectively securely attached to sidewalls of the web. As a result, the structural member, in cross-section, has a X-beam appearance.

In conventional wooden I-beam construction, alignment between the top and bottom flanges is critical to strength of the connection; particularly where the area of contact between the flange and the web member is small. Since the wedge shaped flanges of the subject invention are effectively aligned with the elongate edges of the web, alignment between the flanges is easy to achieve.

It will also be apparent that wooden structural members manufactured in accordance with this invention can be fabricated so that the contact areas between the flanges and the web can increase proportional to beam depth or to the beam design bending moment, in order to ensure adequate shear capacity. Furthermore, and in addition to being able to control the bonded area between the flange and the web, the beam width, height, and flange cross-sectional area versus amount of web cross-sectional area, can also be manipulated in order to optimize for strength and/or cost.

The elongate web can be made up from solid wood, for example a plank, or preferably from a wood composite, such as waferboard, orientated strand board, particleboard or plywood. The flanges similarly can be made up from either solid wood or wood composites, such as laminated veneer lumber, glue laminated lumber, particleboard or plywood.

In cross-section, the structural member of this invention is confined within an imaginary rectangle, top and bottom sides of which are respectively in the same planes as the first and second beam surfaces and preferably correspond to the transverse length of the beam surfaces.

The angle of web is a function of the desired width and height of the finished beam, and can be expressed as follows:

$$\beta = \mathrm{Tan}^{-1}(h/w)$$

where:

$\beta$ is the angle of inclination of the elongate web h is the height (or depth) of the beam measured between the two opposite beam surfaces, and w is the width of the surface portion of the flanges Advantageously, the wedges which are placed on either side of the web section can be produced simply by diagonally ripping rectangular wood stock such as 2×3 inch or 2×4 inch lumber, or by sawing round logs through the centre of the logs. Furthermore the flanges, when secured to opposite sides of the web section, result in a balanced beam element, having a neutral axis of rotation, extending longitudinally and centrally through the web lengths.

The cross-section of the wedge shaped flanges is preferably triangular or trapezoidal, and preferably that of an isosceles triangle with the tapering sidewalls of the flanges gradually decreasing towards the neutral axis of the beam. A vertical load applied perpendicular to the beam surfaces passes through the centroid of the web member, corresponding to its neutral axis. This configuration is efficient in resisting the bending moment as experienced in beam loading applications, since the normal stress distribution in beam cross-section, due to the bending moment, is highest at the top and bottom surfaces and gradually reduces to zero at the neutral axis.

The point of intersection of the two tapering walls of the wedge, relative to the beam surface from which the wedge extends, for strength purposes, is preferably outboard of the neutral axis and extends an amount equal to or greater than one half the depth of the beam.

The foregoing and other features and advantages of the subject invention will be more readily understood from the following description.

DETAILED DESCRIPTION OF THE DRAWINGS

Figure 1:
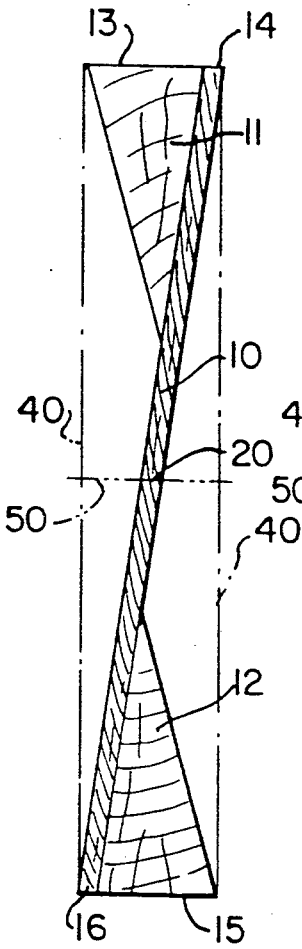
FIGS. 1 through 3 represent, in cross-section, different embodiments of wooden structural X-beams constructed in accordance with this invention.

In the accompanying drawings, the same reference numerals have been used to denote like parts.

Figure 2:
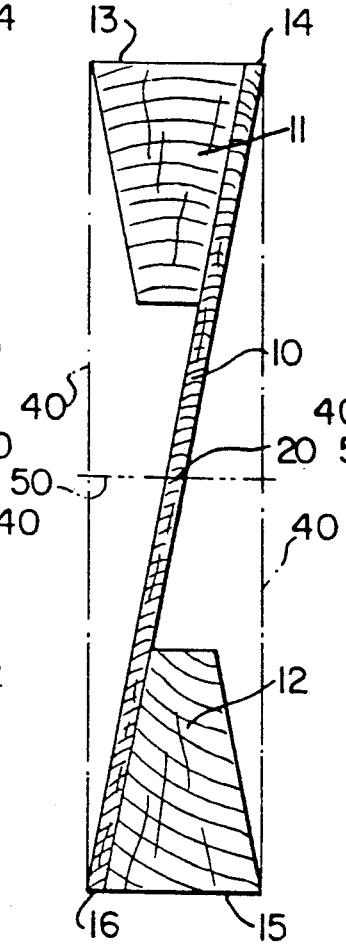
Figure 3:
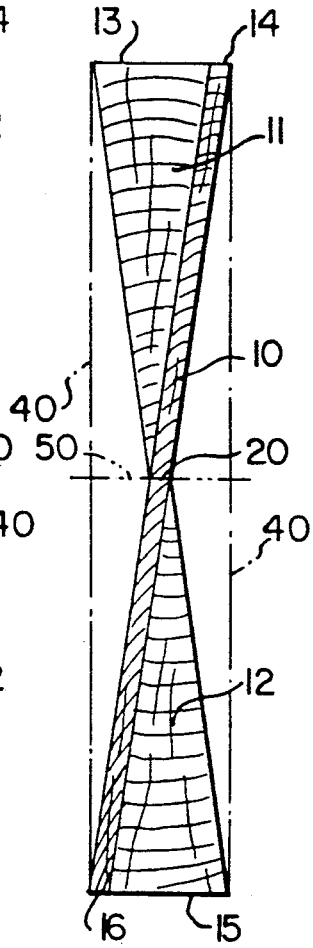

As seen in FIGS. 1 through 3, each beam is made up from a web or plate section 10 and top and bottom wedge shaped flanges 11 and 12 disposed on either side of web 10. The flanges are securely attached to the web employing an adhesive or mechanical fastening means, or both (not shown).

As illustrated, the first or upper flange 11 have an exterior wall 13 which, together with edge 14 of web 10, forms the first or top beam surface of the structural member. Similarly, exterior wall 15 of the second or bottommost wedge shaped flange 12, together with the bottom edge 16 of web 12, forms the second or bottom beam surface of the structural member. Broken lines 40 represent the two opposite sides of an imaginary rectangle where the remaining two opposite sides consist of the above described first and second beam surfaces.

Relative to the top and bottom beam surfaces, the centroid of the beam, which corresponds to the neutral axis of rotation of the beam, is illustrated at point 20.

From a strength standpoint and given all outer dimensions are equal, it will be evident that beams constructed in accordance with that of FIG. 3 are the strongest and involve assemblies where the flanges, in cross-section each constitute an isosceles triangle with the apex of the triangle terminating at least at the midpoint of the depth (or height) of the beam represented by broken line 50 which also extends through the neutral axis point 20. Those flanges which are in the form of truncated isosceles triangles, as seen in FIG. 2 are next in load bearing strength, even though the glue depth of the wedge is equivalent to the glue depth of the wedge seen in FIG. 1. As will be apparent, the glue depth of the FIG. 3 X-beam is significantly greater than in FIGS. 1 and 2.

Figure 4:
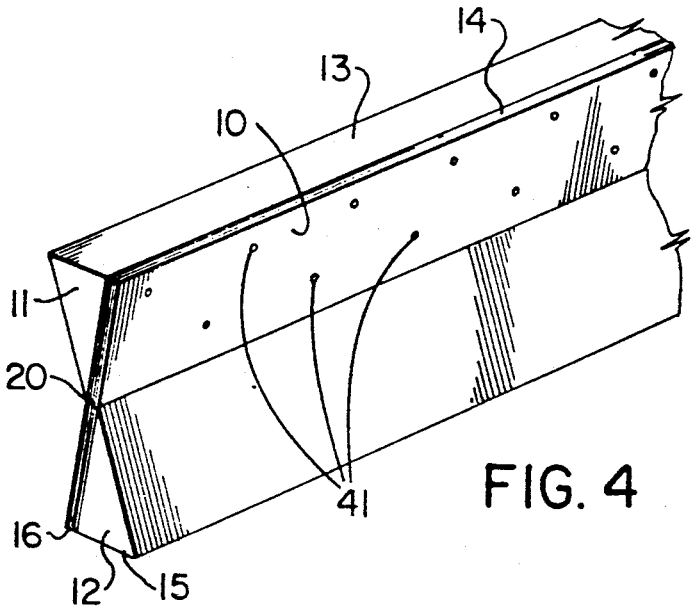
FIG. 4 is a partially cut away perspective view of the X-beam illustrated in FIG. 3.

With reference to FIG. 4, as illustrated, the web 10 is constructed from waferboard with flanges 11 and 12 glued (not shown) on either side thereof and also mechanically attached employing nails 41.

By the very nature of the cross-sectional shape, structural members fabricated in accordance with this invention generally provide greater strength and stiffness capacities than solid lumber having the same quantity of wood. Their flexural strength, however, will be averaged between the strengths of the wood flange and the web, which, in effect, is a load-sharing system. Because of load sharing, the strength properties of beams based on the present configuration will be less prone to strength variation as found in wooden I-beams, and which results from localized defects in either the flanges or the web member of the I-beam.

The strength and stiffness characteristics of the novel structural member of this invention can be calculated on the basis of the component strength and stiffness characteristics, assuming fully composite beam behaviour. This assumption is regarded as valid because of the use of glue for the connection.

By way of illustration, two sets of beams, each of a different size, were fabricated in accordance with the invention and tested in bending and in compression to simulate its use as a beam or columns. One set of beams were made from No. 2 and Better 2×3 inch spruce lumber ripped diagonally for the flange elements and a 7/16" thick waferboard for the web element, forming a X-beam with an outer dimension of 2"×7" in cross-section. The other set of beams were made from No. 2 and Better 2×4 inch spruce lumber ripped diagonally as the flanges, employing the same thickness waferboard as the web element, producing, in this case, a X-beam with an outer dimension of 2"×8".

As indicated above, each piece of lumber was halved diagonally forming two isosceles triangular wedges. A commercially available construction glue of a polyvinyl acetate resin was used for the connection between the flange and the web member, supplemented by two rows of 6 penny common nails spaced at 6" on centre. The between-row distance was 2 inch in the case of the 2"×7" beam, and 3" in the case of the 2"×8" beam. The bending test was carried out in accordance with ASTMD198-84 "Standard Methods of Static Tests of Timbers in Structural Sizes", using an MTS hydraulic close-loop testing system to determine the bending moment and the bending stiffness. The compression test was also carried out in accordance with ASTMD198-84 using a 200 KN capacity Riehle testing machine to determine the compression stiffness and compression load capacity. The tests show the following data in comparison with the estimated mean strength and stiffness capacity data for corresponding spruce lumber:

Stiffness and Moment Capacity in Bending

| | Stiffness ($\times 10^6$ lb. in.$^2$) | Moment ($\times 10^3$ lb. in.) |
|---|---|---|
| 2 × 3 lumber | 2.73 | 3.76 |
| X-beam made from 2 × 3 lumber | 25.80 | 30.59 |
| 2 × 4 lumber | 7.50 | 7.38 |
| X-beam made from 2 × 4 lumber | 43.40 | 47.24 |

| Stiffness and Load Capacity in Compression[1] | | |
|---|---|---|
| | Stiffness ($\times 10^6$ lbf) | Moment ($\times 10^3$ lbf) |
| 2 × 3 lumber | 5.25 | 5.83 |
| X-beam made from 2 × 3 lumber | 5.59 | 19.92 |
| 2 × 4 lumber | 7.35 | 8.17 |
| X-beam made from 2 × 4 lumber | 6.76 | 29.09 |

[1]Note that the moment or load capacity, and stiffness of lumber are taken from Canadian Standard Association CAN3-086.1-M84, adjusted to an "equivalent basis" as the values for the corresponding X-beams which are mean test data.

In comparison with the solid lumber from which the X-beams were made, the X-beams produced in accordance with this invention have substantially higher bending stiffness and moment capacity. In compression, stiffness was about the same between the solid wood and the X-beams, which is as one would expect since there is no substantial difference in cross-section area between them. However, the load capacity was substantially higher for the X-beam configuration than with the original solid wood, due to the load sharing effect between the wood wedge and the web, and the extra capacity provided by the web member.

It was found that a nailing density of a nail per 12 square inches of area was sufficient to provide enough pressure for proper curing of the glue.

On an assembly line basis, it is possible to rough cut both the flanges and webs to dimensions required in cross-section. The flanges can then be attached to their corresponding web sections, using suitable adhesive or mechanical fastening means, or both, as desired. The assembly product can then be trimmed to the desired length and squared to final width dimension desired. By finger or scarf-jointing end-to-end flanges and similarly end-jointing web sections, a rough-cut I-beam of endless length can be fabricated which then undergoes squaring and trimming and cutting to the length desired.

The embodiments of the invention in which an exclusive property of privilege is claimed are defined as follows; I claim:

1. An elongate structural member having a width dimension in member cross-section which is significantly less than its height dimension in such cross-section, said structural member being constructed from first and second substantially identical longitudinal flange elements what are wedge-shaped in cross-section and which are securely fastened to a wooden web section, said web section having opposite sidewalls and a length corresponding to that of said structural member, said structural member being of constant section throughout its length and further characterized by:

(a) a first pair of longitudinally extending opposite beam surfaces and a second pair of longitudinally extending opposite sides, an outline of said first pair of beam surfaces and second pair of sides, in structural member cross-section, being contained within an imaginary rectangle where such outline of said first pair of beam surfaces corresponds to respective ones of two parallel sides of said imaginary rectangle;

(b) said web section, in structural member cross-section, extending diagonally across said imaginary rectangle at an angle, and said first and second longitudinal flange elements being respectively disposed on said opposite side walls of said web; and (c) said first and second flange elements each having a first wall the two of which form at least a major portion of respective ones of said first pair of beam surfaces, a second wall the two of which abut respective ones of said opposite side walls of said web and a third wall the two of which form a portion of respective ones of said second pair of sides, and wherein, in structural member cross-section, the length of said second and third walls of the respective first and second flange elements are each greater than the length of said first wall.

2. The structural member as claimed in claim 1, wherein said first pair of beam surfaces are planar and parallel, and said second pair of sides are symmetrical.

3. The elongate structural member as claimed in claim 2, wherein said web, in structural member cross-section, is a parallelogram and said flange elements, in structural member cross-section, are one of a triangle and a trapezoid.

4. The elongate structural member as claimed in claim 3, wherein said first and second flange elements are securely attached to said web by means of at least one fastening means selected from the group comprising adhesives and mechanical fasteners.

5. The elongate structural member as claimed in claim 1, wherein said structural member is constructed from at least one of wood and wood composite.

6. The elongate structural member as claimed in claim 5, wherein said web, in structural member cross-section is inclined at a predetermined angle, said predetermined angle corresponding to the angle between said first and second walls of each of said first and second flange elements.

7. The elongate structural member as claimed in claim 6, wherein said web has a neutral axis of rotation extending longitudinally through its length and wherein said first and second flange elements, in structural member cross-section, extend inwardly of said structural member a distance corresponding substantially to one half the distance of the depth of the structural member.

8. The elongate structural member as claimed in claim 1, wherein the angle of the diagonally extending web in structural member cross-section is a function of the weight and width of said structural member and which can be expressed as:

$$\beta = \mathrm{Tan}^{-1}(h/w)$$

where:

$\beta$ is the angle of inclination of the web h is the height of the structural member measured between said opposite beam surfaces, and w is the width of the structural member.

9. An elongate manufactured slender member having first and second opposite longitudinal narrow edges made of wood and wood composite elements and intended for use in place of a length of a solid piece of lumber, said member being of constant cross-section throughout its length and comprising:

(a) a first elongate web element having opposite sides and opposite longitudinal edges, comprising a piece of a manufactured wood composite panel, said web element extending the length of said member;

(b) second and third longitudinal respective wedge shape elements each of which is solid wood and has a length extending the length of said member, said first and second elements being disposed respectively on said opposite sides of said web element and adjacent respective opposite longitudinal edges thereof, said wedge shape elements each having a first wall, a second wall and a third face with said first wall, in member cross section, being substantially shorter than said second and third walls, said first wall of said wedge shape elements forming a major portion of respective first and second opposite longitudinal narrow edges of said member; and (c) means securing said wedge shape elements to said web with one of said second and third walls of the respective wedge shape elements abutting said web.

* * * * *